United States Patent [19]

Milner et al.

[11] 4,244,574

[45] Jan. 13, 1981

[54] PINBALL MACHINE WITH CONICAL PLAYFIELD

[75] Inventors: Ronald E. Milner, Grass Valley; Nolan K. Bushnell, Woodside, both of Calif.

[73] Assignee: Atari, Inc., Sunnyvale, Calif.

[21] Appl. No.: 25,123

[22] Filed: Mar. 29, 1979

[51] Int. Cl.[3] ..... A63F 7/00

[52] U.S. Cl. ..... 273/121 A; 273/119 A; 273/122 A

[58] Field of Search ..... 273/121 A, 119 A, 122 A; D21/9, 10

[56] References Cited

U.S. PATENT DOCUMENTS

| | | | |
|---|---|---|---|
| D. 165,740 | 1/1952 | Cooper | D21/9 |
| 2,618,486 | 11/1952 | Durant | 273/121 A |
| 3,785,653 | 1/1974 | Halliburton | 200/61.11 X |

*Primary Examiner*—Robert L. Lindsay, Jr.
*Attorney, Agent, or Firm*—Townsend and Townsend

[57] ABSTRACT

A pinball machine having a main body with a circular upper margin and a conical playing surface extending downwardly from said upper margin and inwardly toward the center of the body. The body has a ball-actuating plunger and curved track near said upper margin so that a ball can be propelled in a circular path along said upper margin and away from the track so that the ball can follow a spiral path and strike one or more targets as it moves over the surface toward the lower extremity thereof. A bumper is mounted on the body near the lower extremity of the conical surface, and the bumper has a shiftable element which is manually actuated by a push-button switch to cause an outward force to be exerted on a ball as the ball approaches the bumper near the lower extremity of the conical surface. The element applies a force to the ball in a certain direction to cause the ball to move upwardly on the conical surface and to strike one or more targets on the conical surface. A display means coupled with the targets receives and displays numerical or other scores associated with the striking of the targets. The body has a return hole and passage near the lower extremity of the surface.

6 Claims, 4 Drawing Figures

PINBALL MACHINE WITH CONICAL PLAYFIELD

This invention relates to improvements in pinball machines and, more particularly, to a pinball machine having a conical playfield.

BACKGROUND OF THE INVENTION

As is well known, pinball machines generally have flat playfields which are slightly tilted so that the balls of the pinball machine, when they are shot one-by-one from a plunger-actuated mechanism along a track to the upper end of the machine, move down the tilted playfield by gravity and strike targets and bumpers of various types. Representative U.S. patents showing various types of pinball machines are as follows Nos: 1,512,985, 1,664,506, 2,582,844, 2,618,486, 3,166,323 and 3,643,954. Of these references, only patent 2,618,486 shows a bowl-shaped body for serving as the playfield; however, the playfield has merely a beveled outer rim and a flat inner surface provided with ball-receiving holes therein. The purpose of the holes is to receive balls for actuating certain switches responsive to the presence of the balls in the holes. The patent does not show a conical playfield and it has been determined that such a playfield is suitable for use with a pinball machine to provide enjoyment for pinball machine players as well as to present a unique surface to add enjoyment to a pinball game while presenting a challenge to players whose skills have been sharpened only on pinball machines having flat playfields.

SUMMARY OF THE INVENTION

The present invention provides an improved pinball machine having a main body provided with a circular upper periphery and a conical inner surface which extends downwardly from the upper margin of the body and inwardly toward the center of the body. The conical surface defines a playfield for the machine. A curved track having a ball-propelling plunger at one end is mounted on the body near the upper margin, the track having an open opposite end so that a ball propelled along the track by the plunger can be moved onto the conical playfield and caused to move along a spiral path and to strike one or more targets on the playfield as it works its way toward the lower extremity of the surface. Display means associated with the targets display scores corresponding to the striking of the targets by the ball.

A thumper-bumper is mounted on the body near the lower extremity of the conical surface or playfield, the bumper having a shiftable element which is actuated manually by a push-button switch selectively operated by the play so that a ball nearing the bumper is caused to strike the element and to be propelled upwardly thereby in a given direction for continued play of the game. Eventually, the ball will move into a return hole and passage for storage.

The playfield can be provided with other accessories, such as fixed bumpers and additional targets, all of which are selected to provide a specific game play. Electrical circuitry associated with the actuation of the shiftable element of the thumper-bumper and the display means is provided in the body. The play of the game is conventional in that a number of ball are successively propelled onto the playfield and caused to strike targets to generate scores which are recorded and displayed on the display means.

The primary object of this invention is to provide an improved pinball machine having a conical playfield and a thumper-bumper near the lower extremity of the playfield, the bumper being manually actuated to apply forces to a ball to keep it in play until it eventually enters a ball-return hole.

Other objects of this invention will become apparent as the following specification progresses, reference being had to the accompanying drawings for an illustration of the invention.

IN THE DRAWING

Figure 1:
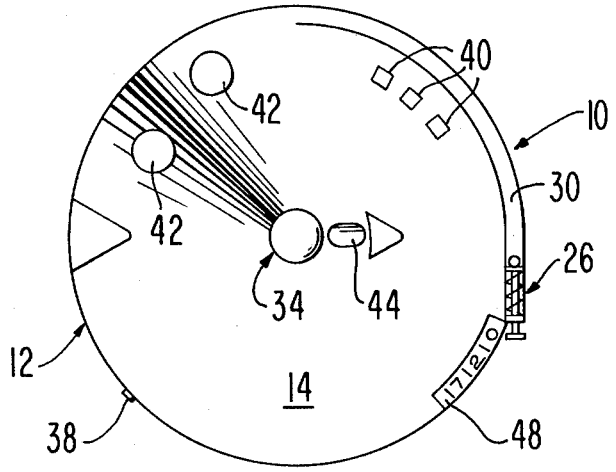
FIG. 1 is a top plan view of the improved pinball machine of the present invention.
Figure 2:
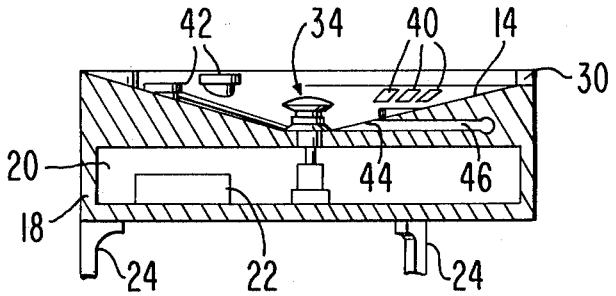
FIG. 2 is a cross-sectional view taken along line 2—2 of FIG. 1.

The pinball machine of the present invention is broadly denoted by the numeral 10 and includes a body 12 having a conical playing surface or playfield 14 extending downwardly from the open top 16 thereof. Body 12 can be of any suitable construction. For purposes of illustration, it is solid throughout a major portion thereof but it could be hollow, if desired. It may be made of any suitable material, such as wood, plastic or metal. If plastic, body 12 can be molded to present the specific conical shape for surface 14. Body 12 has a lower skirt 18 surrounding a space 20 which contains electrical circuitry 22 and other accessories needed to operate the machine. Skirt 18 rests on a number of legs 24, such as three legs to present a tripod support so that the machine can be mounted on a floor with the upper margin of body 12 typically at a height suitable for permitting operation of the machine by an adult.

Body 12 has a ball shooting mechanism 26 at the upper margin thereof, mechanism 26 including a manually actuated plunger 28 for shooting a ball in a track 30 so that the ball motion will be similar to that of a ball of a roulette wheel as the ball leaves track 30 at the open exit end 32 thereof after being propelled forwardly along the track by the shifting movement of plunger 28. The ball then moves onto surface 14 and moves in a spiral path as it decends toward the center of the surface due to gravity. As it moves over the surface 14, the ball can strike one or more targets 40 and this action is recorded and then displayed as numerical or other scores on a display means 48.

Figure 3:
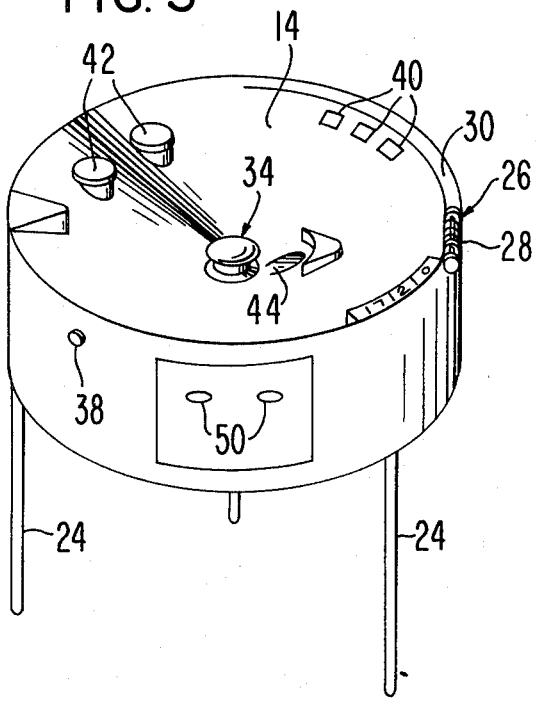
FIG. 3 is a perspective view of the pinball machine.

A bumper 34 is carried by body 12 near the lower extremity of surface 14. Bumper 34 is of the thumper-bumper type which has a laterally shiftable element 36 thereon which is actuated by a switch (not shown) operated by a push button 38 (FIGS. 1 and 3) mounted on the side of body 12 near the upper margin thereof. Shiftable element 36 operates to apply a force to a ball approaching bumper 34 on surface 14 so that the ball is forced away from the bumper and upwardly of surface 14 for continued movement along the same and typically along a spiral path. So long as element 36, when actuated by depressing push-button 38, strikes the ball, the ball remains in play on surface 14. It is understood that there could be a greater number of such targets 40 at different locations than those illustrated in FIGS.

1–3. Also, there can be stationery bumpers 42 at various locations on surface 14 to deflect the balls.

Surface 14 also has a hole 44 near bumper 34 and communicating with a passage 46, hole 44 receiving the balls successively during conventional pinball game play, passage 46 returning the balls to a location from whence they are either manually or automatically elevated one-by-one into a position in track 30 for movement along the track upon actuation of plunger 28.

Figure 4:
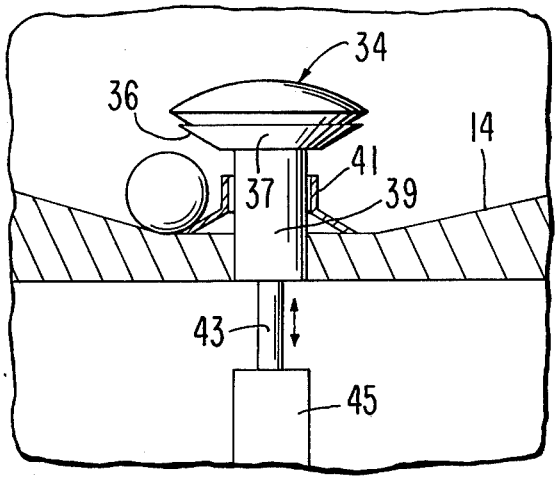
FIG. 4 is an enlarged, fragmentary cross-sectional view of the bumper at the center of the playfield of the machine.

Bumper 34 is preferably conventional in construction in that, as shown in FIG. 4, its element 36 is a beveled ring 37 mounted on the upper end of a shaft 39 shiftably mounted in a sleeve 41 secured to and extending upwardly from surface 14. The lower end of shaft 39 is coupled with the reciprocal shaft 43 of a solenoid 45 carried by body 12. Solenoid 45 is actuated by a switch coupled with push-button 38 so that ring 37 is pulled downwardly to "squeeze" out a ball 47 and cause it to move up surface 12. The timing of operation of the push-button switch controls both the direction of movement of the ball away from the bumper and the force exerted on the ball. The player can essentially "aim" the ball by properly timing the actuation of the push-button. Circuitry 22 provides the control means for actuating element 36 and for controlling display 48.

In operation, the pinball machine 10 is played in a conventional game play manner in which balls are shot one-by-one by the actuation of mechanism 26, each ball being propelled along track 30 and then onto surface 14 so that the ball travels along a spiral path which terminates near bumper 34. As each ball approaches the bumper and is in sufficient proximity to be engaged by element 36, the player depresses push-buttom 38 to actuate element 36 which engages the ball and applies a force thereto in a direction and with a force to cause the ball to move upwardly of surface 14 toward the other playfield objects, the timing associated with actuating the push-button being the controlling factor for both direction of the ball and the force exerted thereon. The ball, as it moves over surface 14, strike one or more targets 40 which provide relative scores; the scores being recorded and displayed on display means 48 observable by the player. The ball then continues through passage 46 and to a holding location.

After the usual number of balls have been played, the game ends and a new game can be started in the usual manner, such as by inserting a coin or coins in a coin slot 50 which are conventionally provided for pinball games.

We claim:

1. A pinball machine comprising: a body having a generally circular upper margin and a conical surface extending downwardly from the upper margin and inwardly toward the central axis of the upper margin, said surface defining a playfield over which a number of balls can move along spiral paths; means near the upper margin for propelling the balls one-by-one along the upper margin for travel onto said conical surface for movement toward the lower extremity thereof; means defining a number of spaced targets on said conical surface at spaced locations thereon; means coupled with the targets for displaying scoring indicia corresponding to striking of the targets by a ball; means near said lower extremity of the surface for defining an actuatable bumper for applying forces to a ball to force the ball upwardly of said lower most extremity; and a manually actuated push-button mounted on the body near the upper margin thereof for actuating said bumper defining means, said body having a ball-return passage communicating with the space above said conical surface near the bumper.

2. A pinball machine as set forth in claim 1, wherein said bumper has a shiftable structure thereon for engaging and applying a force to a ball when the ball approaches the bumper.

3. A pinball machine as set forth in claim 1, wherein said ball propelling means includes a curved track near said upper margin, one end of the track being open, there being a spring-biased plunger near the opposite end of the track for striking a ball along the track and out of the open end and onto said conical surface.

4. In a pinball machine: a body having a generally circular upper margin and a conical surface extending downwardly from the upper margin and inwardly toward the central axis of the upper margin, said surface defining a playfield over which a number of balls can move along spiral paths; means near said lower extremity of the surface for defining an actuatable bumper for applying forces to a ball to force the ball upwardly of said lower most extremity; and a manually actuated push-button mounted on the body near the upper margin thereof for actuating said bumper defining means, said body having a ball-return passage communicating with the space above said conical surface near the bumper.

5. In a pinball machine as set forth in claim 4, wherein said bumper has a shiftable structure thereon for engaging and applying a force to a ball when the ball approaches the bumper.

6. In a pinball machine as set forth in claim 4, wherein said conical surface extends subatantially to said bumper.

* * * * *